US006743071B1

(12) United States Patent
Tronca

(10) Patent No.: US 6,743,071 B1
(45) Date of Patent: Jun. 1, 2004

(54) CHILD FEEDER APPARATUS

(76) Inventor: Harlene G. Tronca, 10270 North Range Line Ct., Mequon, WI (US) 53092-5346

( * ) Notice: Subject to any disclaimer, the term of this patent is extended or adjusted under 35 U.S.C. 154(b) by 0 days.

(21) Appl. No.: 10/302,251

(22) Filed: Nov. 22, 2002

(51) Int. Cl.[7] ..... A63H 3/24

(52) U.S. Cl. ..... 446/304; 446/227; 206/541; 220/796

(58) Field of Search ..... 446/304, 227, 446/71, 77; D21/585, 654; 206/541; 220/789, 793, 780, 326, 796, 801, 802, 805, 4.24, 4.25, 735, 212

(56) References Cited

U.S. PATENT DOCUMENTS

| | | | | | |
|---|---|---|---|---|---|
| 1,751,773 | A | | 3/1930 | Trosper | |
| D146,405 | S | | 2/1947 | Bundy | |
| D148,012 | S | | 12/1947 | Falk | |
| 2,453,922 | A | | 11/1948 | Manaster | |
| 2,455,266 | A | | 11/1948 | Nudelman | |
| 2,731,751 | A | | 1/1956 | Green | |
| 2,864,510 | A | * | 12/1958 | Sture | 220/735 |
| 3,729,136 | A | | 4/1973 | Friedman | |
| 3,791,550 | A | | 2/1974 | Duncan | |
| 4,074,827 | A | * | 2/1978 | Labe, III | 220/522 |
| 4,863,033 | A | | 9/1989 | Buj | |
| D306,386 | S | | 3/1990 | Griffin | |
| 5,540,611 | A | | 7/1996 | Lapoint et al. | |
| 5,638,981 | A | | 6/1997 | Crane et al. | |
| 5,695,086 | A | * | 12/1997 | Viola | 220/793 |
| 5,823,329 | A | | 10/1998 | Roberts | |
| D417,152 | S | * | 11/1999 | Keller et al. | D9/451 |
| D422,502 | S | * | 4/2000 | Keller et al. | D9/451 |
| 6,330,760 | B1 | | 12/2001 | Wolgast | |
| 6,352,258 | B1 | | 3/2002 | Fitzgerald et al. | |

* cited by examiner

*Primary Examiner*—Deryis H. Banks
*Assistant Examiner*—Urszula Cegielnik
(74) *Attorney, Agent, or Firm*—Reinhart Boerner Van Deuren s.c.

(57) ABSTRACT

A device and a method for the use thereof are disclosed for encouraging a child who is a poor eater to eat its food. The device includes a rim member having a contiguous periphery, which defines a central opening, with the underside of the rim member defining a securing portion adapted for securely mating with a peripheral edge portion of a container. A head member is mounted onto the rim member with at least part of the head member being located in a plane above the central opening defined by the rim member. The head member has at least one passageway defined therein, the passageway being adapted to allow access therethrough into and beyond the central opening defined by the rim member.

18 Claims, 4 Drawing Sheets

FIG. 13
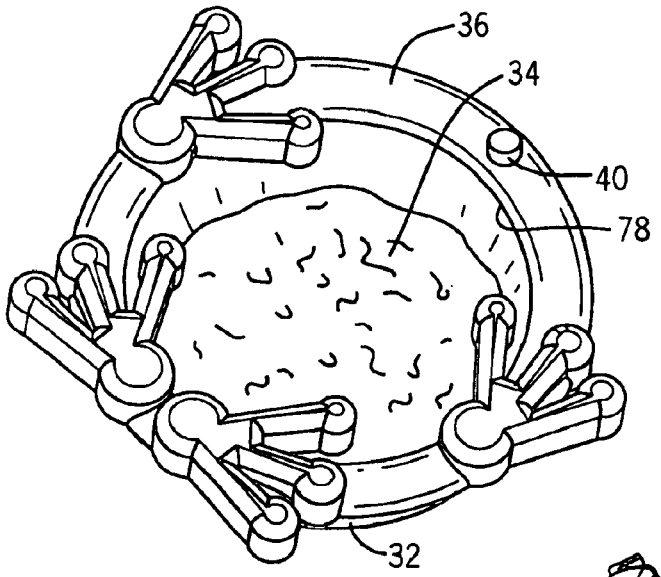
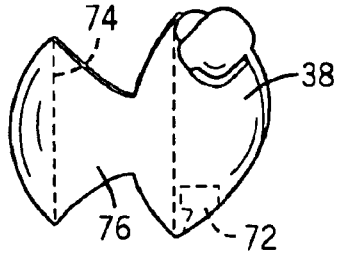
FIG. 14
FIG. 15
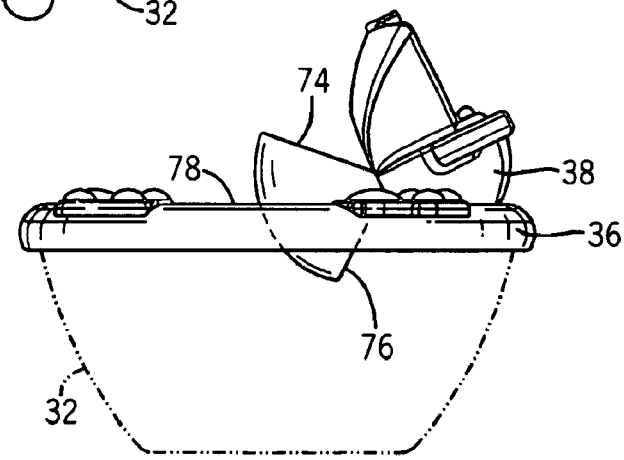
FIG. 16
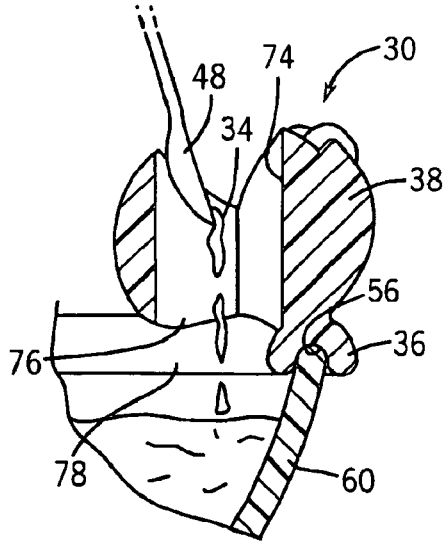

CHILD FEEDER APPARATUS

BACKGROUND OF THE INVENTION

Field of the Invention

The present invention relates generally to an apparatus for use with children who are poor eaters, and more particularly to a child feeder apparatus for use in encouraging such poor eaters to eat more readily.

Many children of all ages, especially toddlers, have the reputation of being poor eaters at feeding time. Consequently, those children continue to frustrate parents and caregivers alike, with no apparent solution in sight. Accordingly, a successful approach to convince a child who is a poor eater to eat is desirable. The preceding notion is reinforced by evidence that suggests a link between a parent's or caregiver's success in encouraging a young child to eat and what new foods that child will subsequently try in the future.

Over time, parents and caregivers have tried many methods and techniques in efforts to encourage children who are poor eaters to eat. Unfortunately, most methods have had limited success at best. For example, one past method consisted of a parent or caregiver first demonstrating the eating process to a child who is a poor eater. To demonstrate the process, the parent or caregiver would attempt to "feed" imaginary food to a make-believe imaginary creature, such as a stuffed animal.

Parents and caregivers have also attempted more realistic, but also less sanitary, feeding approaches. For example, parents and caregivers have tried to illustrate the feeding process to poor eaters by first feeding themselves the child's food with the intent of demonstrating to the child that the food is appetizing and that the child should also eat it. However, because the parent or caregiver is forced to first eat a portion of the child's food from the child's feeding utensil, the technique is unsanitary.

Two previously known embodiments have sought to provide parents and caregivers a simpler way of feeding a poor child eater. For example, although limited in scope, U.S. Pat. No. 2,453,922, to Manaster (the "'922 Patent") and U.S. Pat. No. 2,455,266 to Nudelman (the "'266 Patent") illustrate potentially effective apparatuses and methods of encouraging children who are poor eaters to eat. Both the '922 Patent and the '266 Patent are hereby incorporated herein by reference.

First, as narrowly demonstrated by the '922 Patent, a vibratory or oscillatory amusement and appetite-stimulating feeding device was sought to help stimulate a child's interest in eating. Specifically, the feeding device of the '922 Patent provides a character's body, which rests, for example, upon a table or flat surface adjacent to a feeding container, such as a bowl or dish. The character's body may be an animal figure, such as that of a "begging dog." The animal figure is then positioned so that it overlies the circumferential peripheral edge portion of a bowl.

After positioning the feeding device, a parent or caregiver can insert food into an opening within the feeding device's body. Upon entry of the food into the opening of the feeding device, the food drops into an internal channel and ultimately back toward the recessed area of the adjacent bowl. Concurrent to the insertion of food within the body, the character's head reacts in a vibratory or oscillatory manner in an effort to pique a child's interest in eating the food contained within the bowl.

However, while the feeding device may prove somewhat helpful in aiding parents and caregivers in feeding a poor eater, its usefulness is limited. For example, the feeding device can only be effectively used in combination with a bowl that rests on a substantially level, planar surface. Alternatively, if the feeding device is placed upon an uneven surface adjacent to a bowl, it will not properly hook and engage the bowl's edge.

If the feeding device is not properly assembled to the bowl, proper alignment of the body's food channel with the recessed portion of the bowl is prevented. The usefulness of the feeding device of the '922 Patent is limited in that it can only be effectively used if the apparatus is resting upon a table or other planar, level surface.

The feeding device of the '922 Patent is also limited in that it is only effective if used when the feeding device and the engaged bowl are stationary. For example, if a parent or caregiver picks up the feeding device and the engaged bowl, the feeding device will loosely, but forcibly, swing from its hooking attachment. In short, the loose and unstable swinging motion is highly likely to cause the feeding device to disengage from the edge of the bowl and fall to the ground.

Additionally, because the feeding device is loosely and unsecurely hooked to the edge of the bowl, a small child's waving arms or kicking legs may cause problems. For example, the feeding device's weak engagement with the bowl makes it highly susceptible to being knocked to the floor by a poor eater. Even worse, the engaged bowl may also fall to the floor with the feeding device, thereby spilling the food and creating a mess.

Alternatively, if a parent or caregiver is able to successfully pick up the feeding device and the engaged bowl, a reduction in the efficiency of the apparatus is likely to occur. Specifically, upon lifting the feeding device and the engaged bowl, the body's lower portion will swing forward, toward the container, while the upper portion will tilt rearward, away from the bowl. The body's resultant angular hang will also cause its internal channel to pivot from a substantially vertical position to more of a horizontal position. Such a pivot reduces the efficient gravitational downward flow of food deposited within the channel.

Finally, the feeding device of the '922 Patent is highly limited in scope because it can only be effectively used with a bowl having a circular edge. Further, the body of the feeding device is only adaptable to adjacently abut a bowl that has a hemispherical-shaped exterior. The preceding limitations prevent use of the feeding device with other common, feeding container embodiments having alternate configurations such as square, rectangular, oval, triangular, or other geometric or caricature shaped peripheral edge portions, or body exteriors.

Another previously known feeding device is disclosed by the '266 Patent. Unlike the feeding device of the '922 Patent, the feeding device of the '266 Patent hangs freely from the circular edge of a feeding bowl. The engagement alleviates a user's concern with whether the surface upon which the feeding bowl rests is level or planar. The hanging feeding device also allows a parent or caregiver to pick up the feeding bowl without worrying about whether it or the hanging feeding device embodiment will forcibly disengage or fall to the floor.

However, other limitations in the operation of the feeding device of the '266 Patent exist. For example, due to the feeding device's hanging engagement with the feeding bowl, the feeding device is limited to use with feeding bowls made of a substantial, heavy material. In short, if a lighter weight bowl is used, the hanging embodiment can cause the feeding bowl to tip, thereby spilling the food contained therein.

An additional limitation presented by the feeding device is that it can only be used with feeding bowls that have a circular edge. Specifically, the feeding device has an undercut portion that is of a partial circular nature and can only adapt to hook to a feeding bowl having a circular edge. The feeding device is not adapted for use with, and effective hooking to, a feeding bowl having a straight or non-circular edge. Additionally, the feeding device's body is configured so that it may only hang alongside, and in abbutance to, a feeding bowl.

The feeding device of the '266 Patent is also limited in use due to its loose engagement with the edge of a feeding bowl. For example, because the feeding device only hangs from, and is not securely affixed to, the edge of a feeding bowl, a child may easily knock the feeding device to the floor. Consequently, the feeding device itself, the food contained therein, and possibly even the feeding bowl, can fall to the floor, creating a mess.

Thus, while previously known feeding devices have created advances in efforts to encourage children who are poor eaters to eat, they still have not adequately addressed the needs of such a device. The drawbacks of the previously known devices have been known for some time without any marked improvement thereto occurring to date. Consequently, these devices remain limited in that they are only adapted for use with feeding containers having circular edges. In short, the previously known embodiments are clumsy, inefficient, and inadequate for use with feeding container embodiments other than those having circular edges.

It is accordingly the primary objective of the present invention that it provide a child feeder apparatus that may be more successfully used to encourage a child who is a poor eater to eat.

It is another objective of the present invention that it provide a child feeder apparatus having a contiguous rim member which defines a central opening. Moreover, it is an objective of the present invention that it also have a head member extending from the rim member and that is at least partially located in a plane above the central opening defined by the rim member.

It is yet another objective of the present invention that it provide a child feeder apparatus that can be securely attached to the peripheral edge portion of a feeding container.

It is an additional objective of the present invention that the rim member of the child feeder apparatus can be securely attached to the entire peripheral edge portion of a feeding container.

In short, the present invention provides a child feeder apparatus which is adapted to securely attach to any previously known feeding container on the market such as, but not limited to, containers which are sold under the brand names TUPPERWARE®, ZIPLOC®, RUBBERMAID®, GLAD®, and ANCHOR-HOCKING®, as well as similar house brand or generic containers.

The child feeder apparatus of the present invention is also of a construction which is both durable and long lasting, and which requires little or no maintenance to be provided by the user throughout its operating lifetime. In order to enhance the market appeal of the child feeder apparatus, it should also be of inexpensive construction to thereby afford it the broadest possible market. Finally, it is also an objective that all of the aforesaid advantages and objectives of the child feeder apparatus of the present invention be achieved without incurring any substantial relative disadvantage.

SUMMARY OF THE INVENTION

The disadvantages and limitations of the previously known embodiments discussed above are overcome by the present invention. The present invention allows parents and caregivers to more successfully encourage a child who is a poor eater to eat its food. It is contemplated that the apparatus includes a rim member having a contiguous periphery, which defines a central opening. The rim member further has an underside defining a securing portion adapted for securely mating to a peripheral edge portion of a feeding container, which peripheral edge portion defines an opening.

The child feeder apparatus of the present invention further includes a head member, which extends from the rim member and which is at least partially located in a plane above the central opening defined by the rim member. The head member has at least one passageway defined therein, the passageway being adapted to allow access into the central opening defined by the rim member.

Using previously known molding technology, the rim member of the present invention can be formed unitarily, or alternatively created from a set of components. Moreover, the rim member of the child feeder apparatus can further include a holder for the temporary storage of a feeding utensil. Consistent with well-known molding technology, the rim member may also include, upon its upper, visible portion, associated embodiments. For example, it is envisioned that the rim member can have caricature "appendages," which are specific, and which correspond to the head member of the present invention. Thus, as the head member of the present invention varies, so too can the associated rim member "appendages."

The rim member of the present invention can be manufactured from conventional polypropylene-type material that is already known and is commonly used by reusable or disposable containers, which may contain food. Such already known containers include, but are not limited to, containers which are sold under the brand names TUPPERWARE®, ZIPLOC®, RUBBERMAID®, GLAD®, and ANCHOR-HOCKING®, as well as similar house brand or generic containers.

Regardless, it is envisioned that the rim member of the present invention, particularly the underside thereof, will have a channel formed within it. The channel, which acts as a securing portion, is adapted to detachably affix to a container's peripheral edge portion. For example, it is contemplated that the securing portion of the present invention may be interference fit with the peripheral edge portion of those containers already well known within the marketplace. In place of a channel, it is further contemplated that the rim member of the present invention may alternatively include either an inwardly extending flange or an outwardly extending flange. The flange would be interference fit with the peripheral edge portion of a container.

The rim member of the present invention may embody various shapes. The shapes may include, but are not limited to, those that are circular, non-curvilinear, square, rectangular, oval, triangular, or of another geometric or caricature shape. In short, it is contemplated that the rim member of the present invention is arranged and configured so that it can be securely attached to the containers which are sold under the brand names TUPPERWARE®, ZIPLOC®, RUBBERMAID®, GLAD®, or ANCHOR-HOCKING®, as well as similar house brand or generic containers.

The rim member of the present invention thus presents an embodiment that allows for secure attachment to the entire peripheral edge portion of any of the aforementioned common containers. Accordingly, when securely attached to a container, a parent or caregiver may freely move or pick up the container and attached child feeder apparatus without the worry of whether the child feeder apparatus will become dislodged or fall to the floor.

In addition to the rim member, the present invention also includes an upwardly extending head member. This head member can be formed from the same polypropylene-type composition and molding processes that are used in the formation of the rim member. Alternatively, the head member can be made of a different material. Regardless, the rim member and the head member can be formed either unitarily or as separate, optionally detachable components.

If the rim member and the head member are formed as separate pieces, they can be securably affixed at a connection point, either permanently or in a detachable manner. For example, the attachment mechanism may include the use of a molded extension of either the rim member or head member, which forms a male connecting element. The extending male connecting element can be inserted into a corresponding aperture, which forms a female connecting element. Either connecting element can be on either the head member or the rim member, with the other connecting element being on the other member, with the two connecting elements locking together to thereby form a securable attachment.

Alternatively, the securing relationship may embody a lateral sliding connection of either the rim member or the head member upon a protruding element extending from the other member. More specifically, the protruding element may also include at least one laterally extending flange so that a "T" shape or an upside-down "L" shape is formed. Either the rim member or the head member may then laterally slide into place upon the protruding element. Consequently, such an attachment would prevent detachment without lateral movement. It is contemplated that a user can thus interchange alternate head members for use with a particular rim member (or vice versa), thereby affording a parent or caregiver to provide more variety when attempting to encourage a poor child eater to eat.

The preferred embodiment of the head member of the present invention extends outwardly from the rim member. It is envisioned that the head member may consist of, but is not limited to, a caricature, such as a caricature of the head of an animal. It is contemplated that the head member includes at least one passageway, which has at least one corresponding outlet. The passageway and outlet of the head member will overlie at least a portion of the central opening of the rim member.

Alternatively, if not overlying at least a portion of the central opening, the passageway and outlet may have an angular slope or extension, such as a tube or the like, for directing deposited food into the feeding container. Regardless, the passageway descends from a wide, open caricature mouth. The passageway and outlet of the head member are adapted to allow deposited food to freely flow therethrough. A deposit of food within the passageway thus constitutes a "feeding" of the caricature.

Once a food substance is deposited into the head member, it gravitationally falls freely downward. The food falls through the passageway, from the outlet, through the central opening of the rim member, through the open top portion of the feeding container, and into the interior of the feeding container. Thus, without waste and in a time-efficient manner, the present invention allows a parent or caregiver to simulate the feeding of a caricature in an attempt to encourage a poor eater to eat.

The present invention also provides for a method of using the child feeder apparatus. Specifically, the steps include: providing a child feeder apparatus having a contiguous rim periphery portion and an upwardly extending head member; securing the rim member to a peripheral edge portion of a feeding container by an interference fit; and introducing food into the mouth of the head member. The introduced food is gravitationally moved from within the head member through a passageway to the interior of an attached container located below the rim of the child feeder apparatus.

It may therefore be seen that the present invention teaches a child feeder apparatus having a rim member with a contiguous periphery, which defines a central opening, and which may be securely attached to the peripheral edge portion of a container. The present invention also has a head member that extends from the rim member and that is at least partially located in a plane above the central opening defined by the rim member.

The child feeder apparatus of the present invention is of a construction which is both durable and long lasting, and which requires little or no maintenance to be provided by the user throughout its operating lifetime. The child feeder apparatus of the present invention is also of inexpensive construction to enhance its market appeal and to thereby afford it the broadest possible market. Finally, all of the aforesaid advantages and objectives of the child feeder apparatus of the present invention are achieved without incurring any substantial relative disadvantage.

DESCRIPTION OF THE DRAWINGS

These and other advantages of the present invention are best understood with reference to the drawings, in which:

FIG. 13 is a perspective view of the rim member illustrated in FIGS. 1 and 2 without the head member attached thereto;

FIG. 14 is a side view of the head member illustrated in FIG. 1;

FIG. 15 is a side view of the assembled child feeder apparatus illustrated in FIGS. 1 and 2 attached to a container, which is shown in phantom lines; and FIG. 16 is a partial cross-sectional view of the head member and the rim member of the child feeder apparatus illustrated in FIGS. 1 and 2, wherein the "feeding" of the caricature is illustrated.

DETAILED DESCRIPTION OF THE PREFERRED EMBODIMENT

The preferred embodiments of the present invention are illustrated generally in FIGS. 1–16. More particularly, the preferred embodiments of the present invention involve a child feeder apparatus having a rim member of a contiguous periphery, which defines a central opening. Additionally, the preferred embodiments also include a head member, which extends from the rim member and which is at least partially located in a plane above the central opening defined by the rim member. The present invention may be manufactured to securely adapt to containers having peripheral edge portions and exteriors of circular, square, rectangular, oval, triangular, or other geometric or caricature configurations. Finally, the preferred embodiments described herein also detail a manner of using the present invention.

Figure 1:
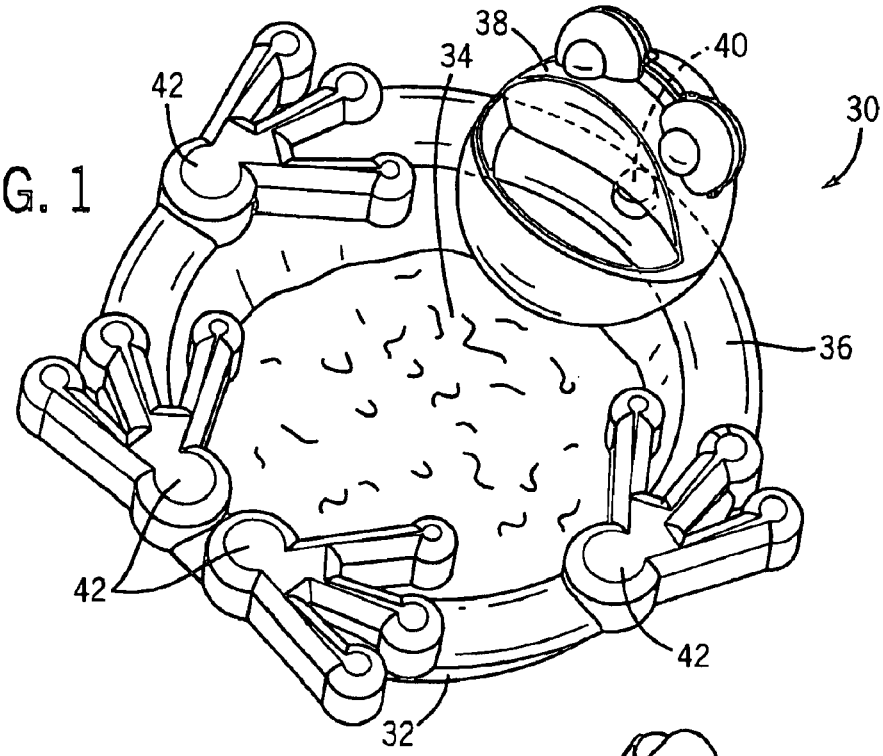
FIG. 1 is a perspective view of the child feeder apparatus, illustrating the head member as it is attached to the rim member.
Figure 2:
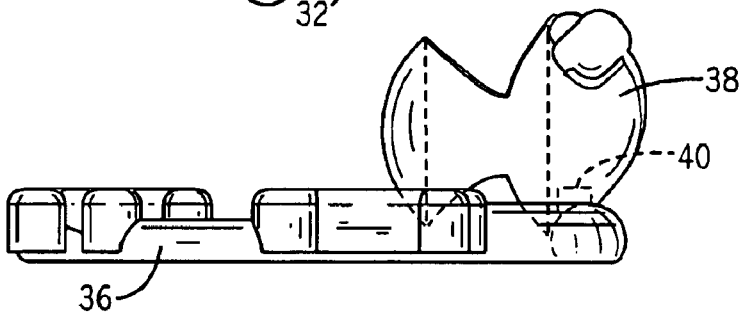
FIG. 2 is a side view of the child feeder apparatus illustrated in FIG. 1.

Referring first to FIG. 1, illustrated is the child feeder apparatus 30 of the present invention mounted onto a container 32. The underside of the child feeder apparatus 30 is securely affixed to a peripheral edge portion (not shown) of the container 32, which is shown as having food 34 contained therein. More specifically, FIG. 1 depicts a rim member 36 and a head member 38 attached to the rim member 36 with a connector 40, which is located on the rim member 36. Present upon the rim member 36 are four appendages 42, such as arms, legs, hands, feet, or the like, which can be associated with the caricature type of the attached head member 38. Like FIG. 1, FIG. 2 also illustrates the attachment of the head member 38 to the rim member 36 with the connector 40.

Figure 3:
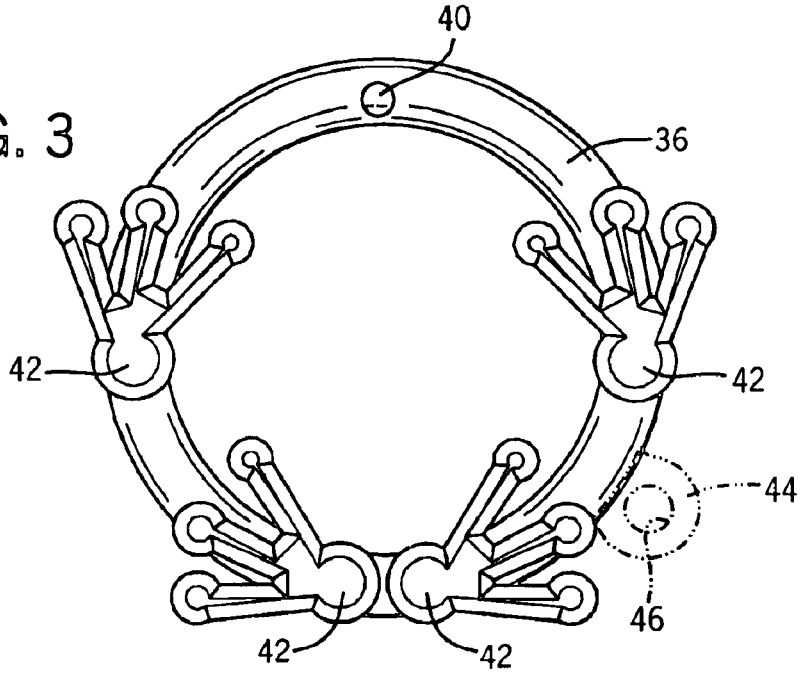
FIG. 3 is a top view of the rim member of the child feeder apparatus illustrated in FIGS. 1 and 2, with the head member removed, showing a feeding utensil holder in phantom lines.
Figure 4:
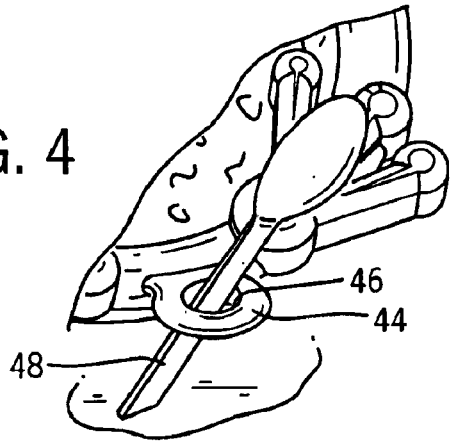
FIG. 4 is a perspective view of a portion of the rim member illustrated in FIG. 3, showing a spoon being held by the feeding utensil holder.

FIG. 3 depicts the top of the rim member 36 of the present invention. Further illustrated in FIG. 3 are the aforementioned appendages 42 and the connection point 40. Additionally, a feeding utensil holder 44 is shown in phantom lines extending from the side of the rim member 36. Referring now to FIG. 4 in addition to FIG. 3, the feeding utensil holder 44 defines a feeding utensil aperture 46 located therein. The feeding utensil holder 44 can be formed unitarily with the rim member 36 through conventional molding techniques or be otherwise affixed thereto, by adhesives or in another manner. As illustrated in FIG. 4, a feeding utensil 48 may insert into the feeding utensil aperture 46 of the feeding utensil holder 44 to thus temporarily store the feeding utensil 48.

Figure 5:
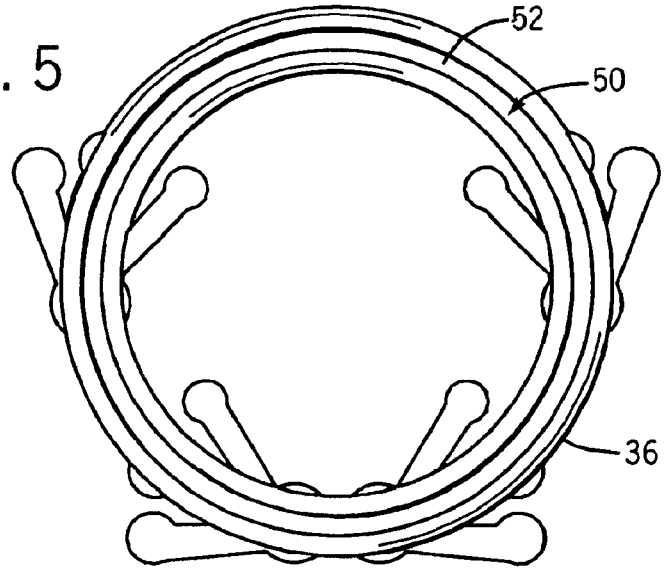
FIG. 5 is a bottom view of the rim member illustrated in FIG. 3.

FIG. 5 illustrates the underside of the rim member 36. The underside, better known as the "securing portion" 50, has formed within it a channel 52. The channel 52 is adapted to receive the peripheral edge portion (not shown in FIG. 5) of a feeding container (also not shown in FIG. 5) in an interference fit. Alternatively, in place of the channel 52, the securing portion 50 can instead include an inwardly extending or outwardly extending flange (not shown in FIG. 5) for an interference fit with the inside or the outside, respectively, of the peripheral edge portion of a feeding container.

Figure 6:
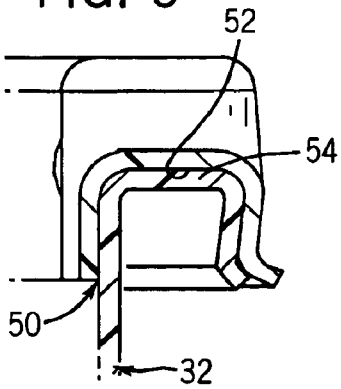
FIG. 6 is a partial cross-section view of the rim member of FIGS. 3 and 5 and a portion of a first type of container, showing the interference fit of the underside of the rim member with the peripheral edge portion of the container.
Figure 7:
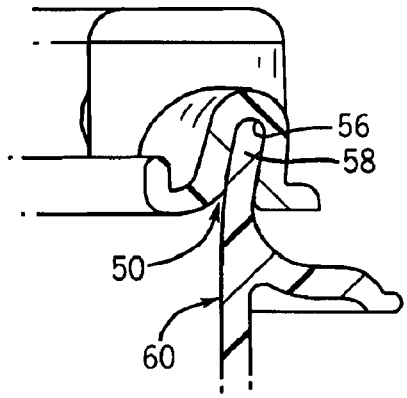
FIG. 7 is a partial cross-section view of an alternate embodiment rim member and a portion of a second type of container, showing the interference fit of the underside of the rim member with the peripheral edge portion of the alternate container.
Figure 8:
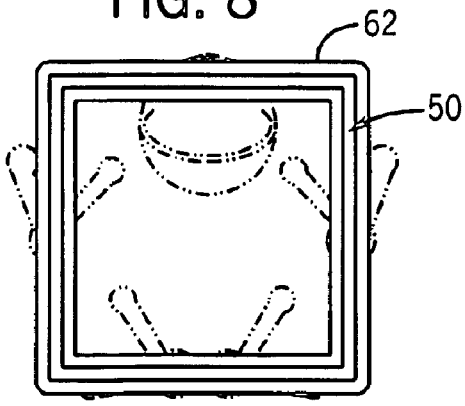
FIG. 8 is a bottom view of a rim member having a square configuration.
Figure 9:
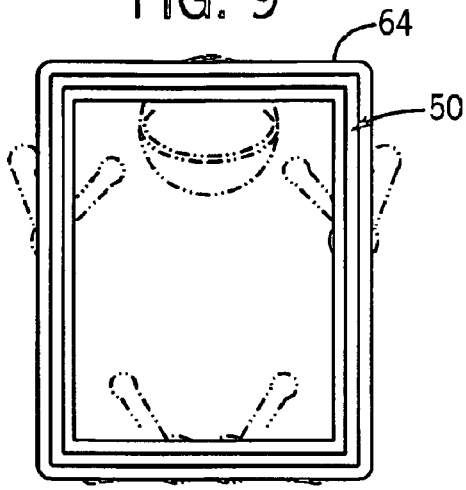
FIG. 9 is a bottom view of a rim member having a rectangular configuration.
Figure 10:
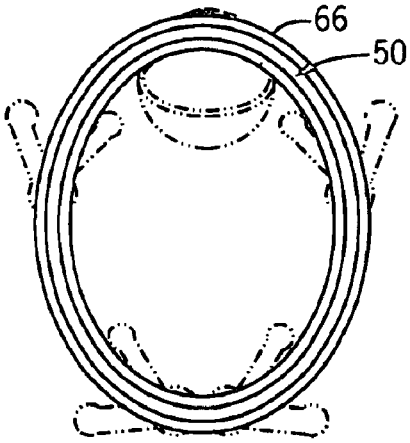
FIG. 10 is a bottom view of a rim member having an oval configuration.
Figure 11:
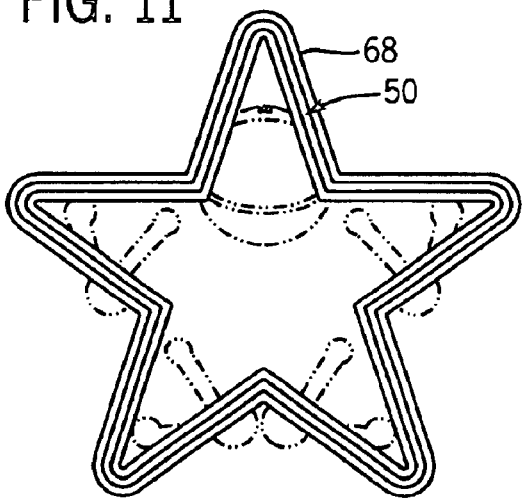
FIG. 11 is a bottom view of a rim member having a star-shaped configuration.
Figure 12:
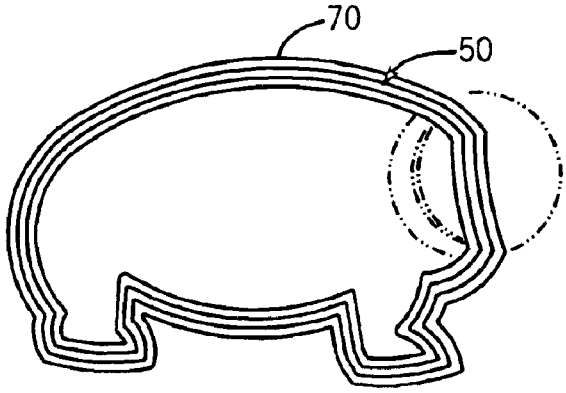
FIG. 12 is a bottom view of a rim member having a configuration resembling the body and legs of an animal.

Turning now to FIGS. 6 and 7, illustrated are two examples of the variety of ways the securing portion 50 of the present invention may securely attach to the peripheral edge portion 54 of a feeding container. Particularly, FIG. 6 illustrates the receipt of the peripheral edge portion 54 of a disposable container such as the ZIPLOC® brand type of container 32 within the securing portion 50, which in this case is the channel 52 . Alternatively, as illustrated in FIG. 7, the securing portion 50 may instead have a narrower channel 56 for receipt therein of a peripheral edge portion 58 of containers such as the TUPPERWARE® brand type of container 60. The design of the channels 52 and 56, as well as other types of channels for use with other types of containers, are all well known to those of skill in the container arts.

Referring next to FIGS. 8 through 12, a number of alternate embodiment configurations for the securing portion 50 of the present invention are illustrated. As shown, rim members can be manufactured to conform to the configuration of various sizes and shapes of feeding containers. FIGS. 8 through 12 respectively show a square rim member 62, a rectangular rim member 64, an oval rim member 66, a star-shaped rim member 68, and a caricature rim member 70, which is shaped like the body and legs of an animal. Accordingly, the securing portion 50 of the present invention may secure to peripheral edge configurations that are circular, non-curvilinear, square, rectangular, oval, or of another geometric or caricature shape.

Turning now to FIGS. 13 and 14, shown is the connection of the rim member 36 with the head member 38 using the connector 40, which extends from the rim member 36. In securing the rim member 36 and head member 38 together, the connector 40 and a receiving element 72 can be used to form a mating relationship to secure the head member 38 to the rim member 36, either permanently or removably. The connector 40 can fit into the receiving element 72 in the head member 38 with an interference fit (removably) or by means of adhesive (permanently).

Alternatively, the rim member 36 can be connected to the head member 38 using a lateral or sliding connection. More specifically, the connector 40 can include at least one lateral extension (not shown) so that a "T" or an upside-down "L" shape is formed. The female counterpart of the "T" or upside-down "L" shape would have an appropriately shaped receiving element 72 for accommodating such a T-shaped or L-shaped connector. Such a connector would prevent detachment of the head member 38 from the rim member 36 without lateral movement of the head member 38 with respect to the rim member 36.

Turning next to FIG. 15, the head member 38 is illustrated as extending above the rim member 36. The head member 38 includes at least one passageway 74, which has a corresponding outlet 76. The head member 38 of the preferred embodiment overlies at least a portion of a central opening 78 defined by the rim member 36. The passageway 74 of the head member 38 identifies a wide, open caricature mouth, which is sufficiently large to allow deposited food to freely flow therethrough.

Finally, as illustrated in FIG. 16, the child feeder apparatus 30 is ultimately used to encourage a child who is a poor eater to eat. Note that in the embodiment illustrated in FIG. 16, the head member 38 and the rim member 36 are manufactured in unitary fashion. If a child refuses to eat, a parent or caregiver can demonstrate the eating process to the child using the present invention. First, the child feeder apparatus 30 is secured to the peripheral edge portion of a container 60. Then, using the feeding utensil 48, the food 34 is inserted into the passageway 74 of the head member 38, where it falls gravitationally downward through the corresponding outlet 76 of the passageway 74, through the central opening 78 of the rim member 36, through the open top portion 80 of the container 60, and into the recessed area of the container 60 below. Thus, without waste and in a time-efficient manner, the present invention allows a parent or caregiver to simulate the feeding of a caricature in an attempt to encourage a poor child eater to eat.

It may therefore be appreciated from the above detailed description of the preferred embodiment of the present invention that it teaches a novel and unique child feeder apparatus having a rim member of a contiguous periphery, which defines a central opening. The present invention includes a head member which extends from a rim member and which is at least partially located in a plane above the central opening defined by the rim member.

The present invention may be manufactured to securely adapt to fit containers having peripheral edge portions and exteriors of circular, square, rectangular, oval, triangular, or other geometric or caricature configurations. Finally, the present invention also provides a manner of using the child feeder apparatus to encourage a child who is a poor eater to eat.

Although an exemplary embodiment of the child feeder apparatus of the present invention has been shown and described with reference to particular embodiments and applications thereof, it will be apparent to those having ordinary skill in the art that a number of changes, modifications, or alterations to the child feeder apparatus as described herein may be made, none of which depart from the spirit or scope of the present invention. All such changes, modifications, and alterations should therefore be seen as being within the scope of the present invention.

What is claimed is:

1. An apparatus for encouraging a child to eat food contained in a container, said apparatus comprising:

a rim member having a contiguous periphery defining a central opening, said rim member having an underside defining a securing portion adapted for secure but removable attachment to a peripheral edge portion of the container, said peripheral edge portion of the container defining an opening; and a head member extending from said rim member and at least partially located in a plane above said central opening of said rim member, said head member having at least one passageway defined therein, said at least one passageway adapted to allow access to said central opening in said rim member.

2. The child feeder apparatus of claim 1 wherein said securing portion of said rim member comprises a channel.

3. The child feeder apparatus of claim 2 wherein said securing portion of said rim member is removably attachable to the peripheral edge portion of the container in an interference fit.

4. The child feeder apparatus of claim 1 wherein said securing portion of said rim member comprises an outwardly extending flange.

5. The child feeder apparatus of claim 4 wherein said outwardly extending flange is removably attachable to the peripheral edge portion of the container in an interference fit.

6. The child feeder apparatus of claim 1 wherein said rim member is of one-piece construction.

7. The child feeder apparatus of claim 1 wherein said rim member has a geometric configuration which is circular, square, triangular, rectangular, or oval.

8. The child feeder apparatus of claim 1 wherein said head member is removably affixed to said rim member.

9. The child feeder apparatus of claim 1 wherein said head member is unitarily formed with said rim member.

10. The child feeder apparatus of claim 1 wherein said head member comprises a caricature of an animal or a person.

11. The child feeder apparatus of claim 1 wherein said rim member includes caricature appendages.

12. The child feeder apparatus of claim 1 wherein said rim member further comprises a holder for removably storing a feeding utensil.

13. The child feeder apparatus of claim 1 wherein said at least one passageway has an outlet, said outlet overlying at least a portion of said central opening in said rim member.

14. The child feeder apparatus of claim 13 wherein said at least one passageway and said at least one outlet are adapted to allow the free flow of a food substance therethrough.

15. The child feeder apparatus of claim 1 wherein said child feeder apparatus is made of a polypropylene material.

16. An apparatus for encouraging a child to eat food contained in a container, said apparatus comprising:

a rim member having a contiguous periphery defining a central opening, said rim member having a top side defining caricature appendages and an underside defining a channel adapted for an interference fit with a rim located around an opening in the container, said rim member defining a central opening;

a feeding utensil holder extending laterally outwardly from said rim member, said feeding utensil holder having a contiguous periphery defining an opening into which a feeding utensil may be placed; and a head member defining a caricature of an animal or a person, said head member being mounted upon said rim member and being at least partially located in a plane above said central opening of said rim member, said head member having at least one passageway defined therein, said at least one passageway having at least one outlet, said at least one outlet overlying said central opening of said rim member and adapted to allow free flow of a food substance therethrough.

17. An apparatus for encouraging a child to eat food contained in a container, said apparatus comprising:

a rim member having a contiguous periphery defining a central opening, said rim member having an underside defining a channel adapted for securely mating to the container, said peripheral edge portion of said feeding container defining an opening; and a head member extending from said rim member and at least partially located in a plane above said central opening of said rim member, said head member having at least one passageway defined therein, said at least one passageway of said head member having at least one outlet, said at least one outlet overlying at least a portion of said central opening of said rim member and adapted to allow free flow of a food substance therethrough.

18. A method of encouraging a child to eat food contained in a container, said method comprising the steps of:

providing a child feeder apparatus having a rim member of a contiguous periphery and a head member;

securing said child feeder apparatus to a rim of the container, whereby said rim member is securable to the rim of the container in an interference fit; and introducing the food into at least one passageway of said head member of said child feeder apparatus, whereby said introduced food is moved by gravity through said head member back into the container.

* * * * *